US010865552B2

(12) United States Patent
Homami et al.

(10) Patent No.: US 10,865,552 B2
(45) Date of Patent: Dec. 15, 2020

(54) SIMPLIFIED DRAIN PLUG WITH OVERFLOW RELEASE

(71) Applicant: Westbrass Company, Los Angeles, CA (US)

(72) Inventors: Max Homami, Los Angeles, CA (US); Marc Gregory Martino, Westlake Village, CA (US)

(73) Assignee: WESTBRASS COMPANY, Los Angeles, CA (US)

( * ) Notice: Subject to any disclaimer, the term of this patent is extended or adjusted under 35 U.S.C. 154(b) by 5 days.

(21) Appl. No.: 15/808,899

(22) Filed: Nov. 10, 2017

(65) Prior Publication Data

US 2018/0127961 A1 May 10, 2018

Related U.S. Application Data

(60) Provisional application No. 62/420,433, filed on Nov. 10, 2016.

(51) Int. Cl.
*E03C 1/23* (2006.01)

(52) U.S. Cl.
CPC ..... *E03C 1/2306* (2013.01); *E03C 1/2302* (2013.01); *E03C 2001/2311* (2013.01)

(58) Field of Classification Search
CPC ..... E03C 2001/2311; E03C 2001/2317; E03C 1/232; E03C 1/22; E03D 1/23; E03D 1/2302; E03D 1/2306
USPC ..... 4/684, 689, 286–295
See application file for complete search history.

(56) References Cited

U.S. PATENT DOCUMENTS 3,333,815 A * 8/1967 Jones ..... E03C 1/23 251/230
3,428,295 A * 2/1969 Jones ..... F16K 31/528 251/144
5,819,328 A * 10/1998 Lewis ..... A47K 1/14 4/295
6,219,861 B1 * 4/2001 Chen ..... A47K 1/14 251/323
6,347,417 B1 * 2/2002 Ohta ..... E03C 1/2304 4/287

(Continued)

FOREIGN PATENT DOCUMENTS

DE 2263662 A1 * 7/1974 ..... E03C 1/232
DE 2950611 A1 * 6/1981 ..... E03C 1/23
EP 2 281 955 A1 2/2011

*Primary Examiner* — Erin Deery
(74) *Attorney, Agent, or Firm* — Hackler Daghighian Martino & Novak

(57) ABSTRACT

An overflow drain assembly includes a housing configured to be installed at a bottom of a basin. A plug assembly is configured to be disposed within the housing and has an upper and lower plug body translatable to each other. A fluidic seal is attached to the upper plug body and configured to removably engage in a water tight manner with a top side water inlet of the housing. A single compression spring is disposed between and biases apart the upper and lower plug body. A first permanent magnet attached to the lower plug body is above a second permanent magnet attached to the upper plug body. The upper plug body is configured to be manually pushed downward a first time by a user to automatically lock into an open position and manually pushed downward a second time to automatically raise and lock into a closed position.

18 Claims, 10 Drawing Sheets

(56) References Cited

U.S. PATENT DOCUMENTS 8,701,224 B2 * 4/2014 Li ..... E03C 1/2306
4/287
9,151,027 B2 * 10/2015 Lucas ..... E03C 1/2306

* cited by examiner

SIMPLIFIED DRAIN PLUG WITH OVERFLOW RELEASE

CROSS-REFERENCE TO RELATED APPLICATIONS

This non-provisional application claims priority to provisional application 62/420,433 filed on Nov. 10, 2016, the entire contents of which are fully incorporated herein with this reference.

DESCRIPTION

Field of the Invention

The present invention generally relates to drain plugs for tubs and sinks. More particularly, the present invention relates to a drain plug with an overflow release.

Background of the Invention

European Patent Application 2 281 955 A1, filed on May 31, 2010 and published on Feb. 9, 2011, is incorporated herein in its entirety. The inventor's structure taught herein is a major improvement over the '955 European Patent Application as it is simplified design that reduces chance for error, reduces costs and is easier to install and adjust.

SUMMARY OF THE INVENTION

An overflow drain assembly 10, comprises a housing 12 configured to be installed at a bottom of a basin. The housing has respectively a top portion 16 opposite a bottom portion 18. A top side water inlet 20 is disposed at the top portion of the housing and exposed to the contents of the basin and a bottom side water outlet 22 is disposed at the bottom portion of the housing and connectable to a drainage leading away from the basin. A plug assembly 24 is configured to be disposed within the housing. The plug assembly comprises an upper plug body 26 and a lower plug body 28. The upper plug body is translatable with respect to the lower plug body. A fluidic seal 30 is attached to the upper plug body and configured to removably engage in a water tight manner with the top side water inlet of the housing. A compression spring 32 is disposed between the upper plug body and the lower plug body. The compression spring biases the upper plug body to translate away from the lower plug body. The compression spring is the only spring in the overflow drain assembly. A first permanent magnet 34 is attached to the lower plug body. A second permanent magnet 36 attached to the upper plug body. The first permanent magnet is magnetically attracted to the second permanent magnet and the first magnet is disposed at least partially above the second magnet. The upper plug body is configured to be manually pushed downward a first time by a user to automatically lock into an open position where the fluidic seal remains below the top side water inlet and wherein the upper plug body is configured to be manually pushed downward a second time by the user to automatically raise and lock into a closed position where the fluidic seal engages with the top side water inlet in the water tight manner.

Other exemplary embodiments may include a threaded shaft 38 disposed below the lower plug body, wherein the threaded shaft is threadably engaged with the bottom portion of the housing. The threaded shaft may be separate from the plug assembly, wherein the threaded shaft comprises a hex head 40, wherein the hex head of the threaded shaft is accessible through the top portion of the housing when the plug assembly is removed. A top surface 42 of the screw head may be configured to abut a bottom surface 44 of the lower plug body, wherein rotation of the screw head either lowers or raises the top surface of the screw head in relation to the housing.

The threaded shaft 38 may be attached to the lower plug body, and including a hex head attached to either the threaded shaft or the lower plug body.

The hex head may have a larger diameter from its outermost flat surfaces in comparison to the rest of a diameter of the plug assembly, wherein a secondary tool is configured to engage the hex head and rotate the plug assembly allowing the plug assembly to be rotated for either raising or lowering the plug assembly in relation to the housing.

A shim 52 may be disposed between the compression spring and the lower plug body.

An adjustment screw 54 may be threadably engaged with the lower plug body, the adjustment screw configured to push the shim compressing the compression spring when the adjustment screw is rotated.

The housing may include a removable top 14, wherein the top includes the top side water inlet.

The upper plug body may comprise a plurality of guiding structures 46 configured to facilitate a vertical movement of the upper plug body within the housing.

Either, but not both, of the first permanent magnet or the second permanent magnet may be replaced with a ferromagnetic material.

A flange 48 may be attached to the adjustment screw disposed within the housing, the flange configured to prevent the adjustment screw from passing through the bottom side water inlet while being able to pass through the top side water inlet when the plug assembly is removed.

A stop 50 may be attached to a distal end of the adjustment screw disposed beyond the bottom portion of the housing, the stop configured to prevent the adjustment screw from being fully removed from the housing.

The upper plug body may not be rotatable with respect to the lower plug body. A guide channel 56 may be disposed in either the upper or lower plug body and a slide 58 may be disposed in the other of the upper or lower plug body, wherein the slide is configured to translate within the guide channel and prevent rotation between the upper and lower plug body.

The upper plug body may comprise a variable position stepped track 60 configured for a toothed plate 62 to engage therein, the toothed plate disposed between the compression spring and the variable position stepped track, and further including a cam surface 64 attached to the upper plug body, wherein the cam surface is configured to abut the toothed plate disengaging the toothed plate from the variable position stepped track thereby allowing the toothed plate to advance to a different position along the stepped track. The toothed plate may be rotatable and translatable with respect to the upper and lower plug body.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
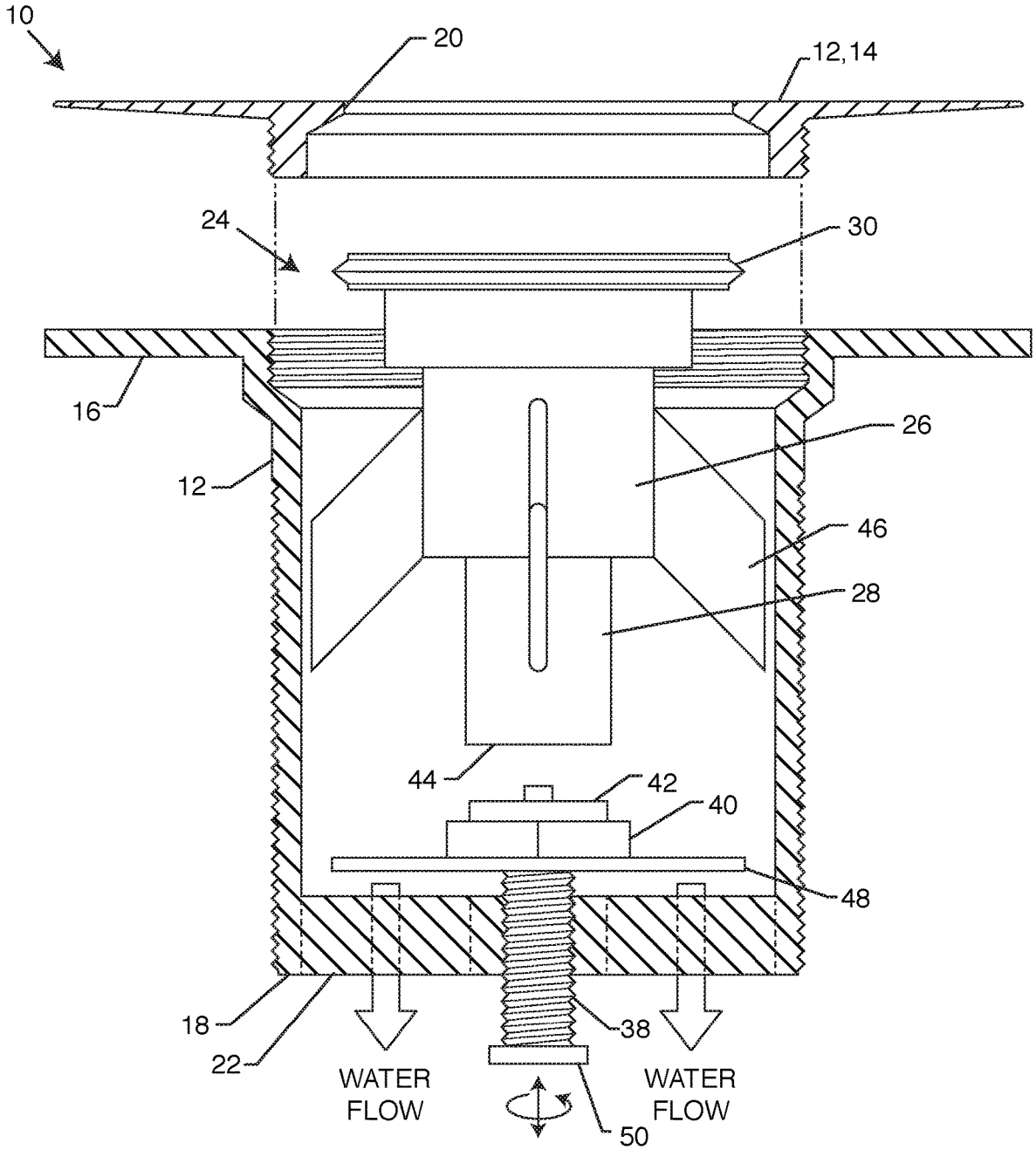
FIG. 1 is a partial sectional and partial side view of a novel structure embodying the present design.
Figure 2:
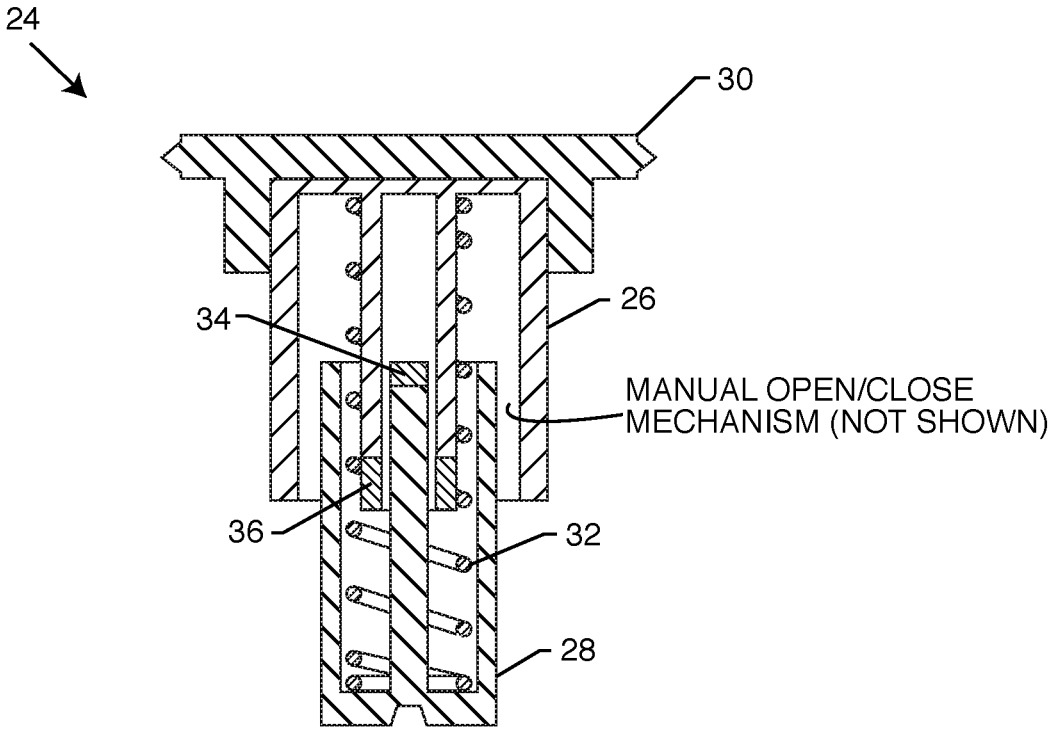
FIG. 2 is a sectional view of the plug body and internal structure from FIG. 1.

FIGS. 1 and 2 are very similar to the sketches originally filed in provisional application 62/420,433 filed on Nov. 10, 2016. As shown in FIGS. 1 and 2, an overflow drain 10 is disclosed and taught herein. However, one must first understand the structure taught in the European Patent Application 2 281 955 A1, filed on May 31, 2010 and published on Feb. 9, 2011, which is incorporated herein in its entirety.

When analyzing the '955 Patent Application, one will notice that there are in fact two springs, the lower spring 30 which is the spring that gives way when the water pressure becomes too great, and the second spring which cannot be seen but is installed within the plug 18. This second spring is the spring the user interacts with by pushing down on the top of the plug manually which then compresses the second spring as the plug body 20 compresses/translates with respect to the plug 18. A user can then click and release such that the top of the plug is below the top of the annular flange 14 thereby allowing water to evacuate through the drain plug assembly. The mechanism and spring contained within the plug 18 and plug body are well known to those skilled in the art as a tip-toe mechanism and need not be further taught and discussed herein because there are literally a multitude of designs that can be used as a tip-toe mechanism. It is also noted that guide elements 40 help align the structure as it translates up and down within the drain body 10.

It is noted that the lower spring 30 is of a significantly lower spring constant when compared to the upper spring (not shown). When a user presses down on the plug, they are actually compressing both the spring 30 and the upper spring (not shown).

The Applicant believes the '955 Patent Application design can be greatly simplified. First, because the lower spring 30 requires less effort, the upper spring can be removed and replaced with the lower spring. The Applicant shows FIGS. 1 and 2 that there is now just one spring as the lower spring assembly has been removed. This spring constant used would be significantly less that the upper spring used in the cited prior art. This would then make it easier for a user to press down on it while at the same time providing the overflow functionality. The Applicant's design is cheaper because it has reduced the overall part count and is more robust as there are now less moving parts.

As can be understood by those skilled in the art when looking at the Applicant's FIGS. 1 and 2, the spring controls both the click and release functionality where the upper plug body and lower plug body translate with respect to one another as is known in the arts. This means the user can press down on the plug such that it remains below the top for evacuating water. Then a second press of the plug releases it and the top of the plug seals to the top thereby trapping and containing water. The fins help keep everything aligned as the parts translate within the housing. Now, in this new design, when the water pressure becomes too great, it will still overcome the spring and release water. Thereby both the open/close functionality and the overflow functionality have been combined in this novel design by using only one spring.

It is noted that in FIGS. 1 and 2 the exact details of the tip-toe mechanism are not shown. Rather, a placeholder for the manual open/close mechanism (tip-toe mechanism) is shown. It is understood by those skilled in the art that there are a multitude of designs that could accomplish such functionality. Just as there are a multitude of clickable pen designs in the marketplace today, similarly there could be a multitude of tip-toe mechanisms and this disclosure is not intended to limit it to just the variations shown herein. Nonetheless, the Applicant does teach a particular design as will be shown in FIGS. 3-10.

Referring back to FIGS. 1 and 2, the user may want to adjust the final height of the water that can be achieved before the overflow functionality releases. In the prior art they teach swapping in different springs to achieve different heights. This is not an optimal way of adjusting the device. To the contrary, the Applicant has invented a novel adjustment screw 38 that can be accessed from above during installation such that only one drain plug assembly is needed. The adjustment screw 38 (threaded post 38) is threaded on one side and engages with the threaded portion of the housing. A hex head 40 (or equivalent structure) is formed on the adjustment screw such that one can reach into the housing with a socket and turn the adjustment screw. Turning the adjustment screw changes its height relative to the housing. It is also then changing its height relative to the plug assembly 24 itself. This means that when the adjustment is higher it will start to compress the spring 32 more such that the spring will resist a larger water pressure. The overall adjustment of the water height will only vary by about 1 to 1.5 feet, maybe 2 feet at an extreme. Therefore, slightly changing the height of the adjustment screw 38 is more than enough to change the preload of the spring 32 such that it can be adjusted to allow for different water heights before it releases water.

The adjustment screw may be too small and fall through the drain housing during installation or adjustment. Therefore, an optional flange 48 can be added that prevents it from falling through the drain. Alternatively, the adjustment screw may have an optional stop 50 permanently attached during manufacturing that prevents a user from fully unscrewing the adjustment screw such that it prevents it falling through the drain.

FIG. 2 is a sectional view similar in nature to the structure of FIG. 1, however FIG. 2 incorporates the use of at least one magnet 34, 36 to help provide additional functionality of the present invention. In FIG. 1, once the water pressure pushing down overcomes the force of spring constant pushing up, the plug will lower and then water will seep through. Once the force of the spring constant is greater than the force of the water pressure pushing down, the plug will seal to the top of the housing. At this boundary condition where the force of the spring and water pressure are about equal, the water constantly seeping through might become annoying or undesirable. Therefore, in some embodiments it may be desirable to drain a substantially larger amount of water before the plug seals to the top.

FIG. 2 shows an embodiment that uses at least one magnet to create such an effect. For example a first magnet 34 is placed onto a post of the lower plug body. A second magnet 36 is placed on a cylindrical extension of the upper plug body. The two magnets are attracted to one another. It is understood herein that only one magnet could be used as the other magnet replaced with a ferromagnetic material to further reduce the overall cost of the final assembly.

Magnets 1 and 2 are attracting towards one another, such that they force the plug upwards. This means that the spring and magnets are working together to resist the force of water pressure pushing down from above. Once the force of the water overcomes both the spring and the magnets, the distance between the two magnets is increased, which in turn lowers the overall force created between them. The water pressure keeps pushing downwards and then the magnets lose even more force. This then allows the plug body to collapse downwards a further amount in comparison to only using a spring. Once enough water has escaped, the spring overcomes the force of the water pressure pushing downwards and forces the plug upwards to once again seal to the top. At that time the magnets attracting force increases again and helps to keep the plug sealed to the top.

It is also understood that various open/close features would be created and used between the lower plug body and the upper plug body for manual opening and closing of the plug, such as is commonly known by laymen from various push and click ball point pens. These are commonly referred to in the industry as tip-toe mechanisms. However, no specific version are shown herein in FIG. 2 as one skilled in the art knows of a multitude of such constructions and devices that could be used herein, and the exact type of one used can be changes to a different configuration and still work. Rather, for FIG. 2 the interaction of the magnets is of importance to create a draining of a substantial amount of water before the drain seals once again.

From the date of filing of the initial provisional application, actually designing a tip-toe mechanism to be combined with an overflow feature using only one spring was very difficult. The FIGS. 3-10 are one embodiment of how such a structure could be accomplished.

Referring now to the embodiments shown in FIGS. 3-10, an overflow drain assembly 10 comprises a housing 12 configured to be installed at a bottom of a basin, such as a tub or sink. The housing has respectively a top portion 16 opposite a bottom portion 18. A top side water inlet 20 is disposed at the top portion of the housing and exposed to the contents of the basin and a bottom side water outlet 22 is disposed at the bottom portion of the housing and connectable to a drainage leading away from the basin.

Figure 5:
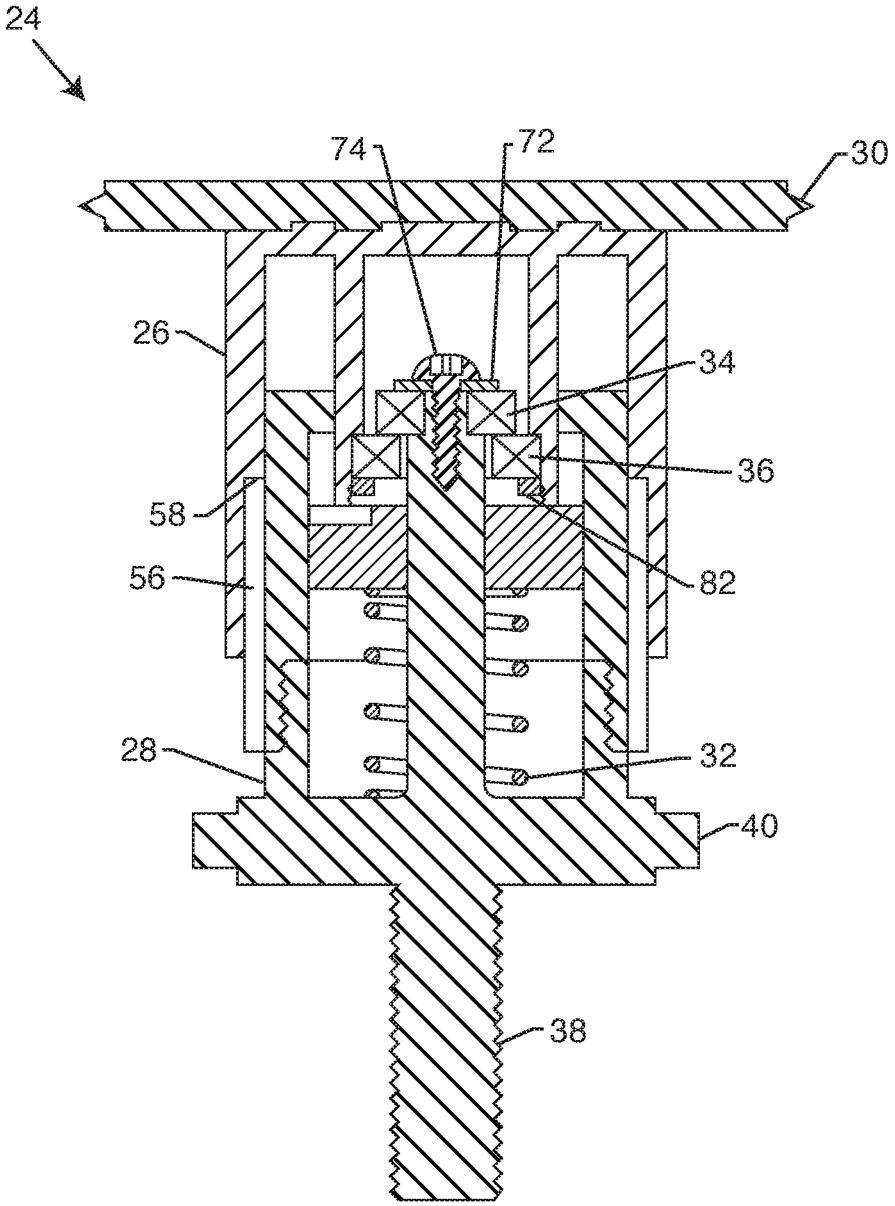
FIG. 5 is a sectional side view of just the plug assembly from FIG. 3.
Figure 6:
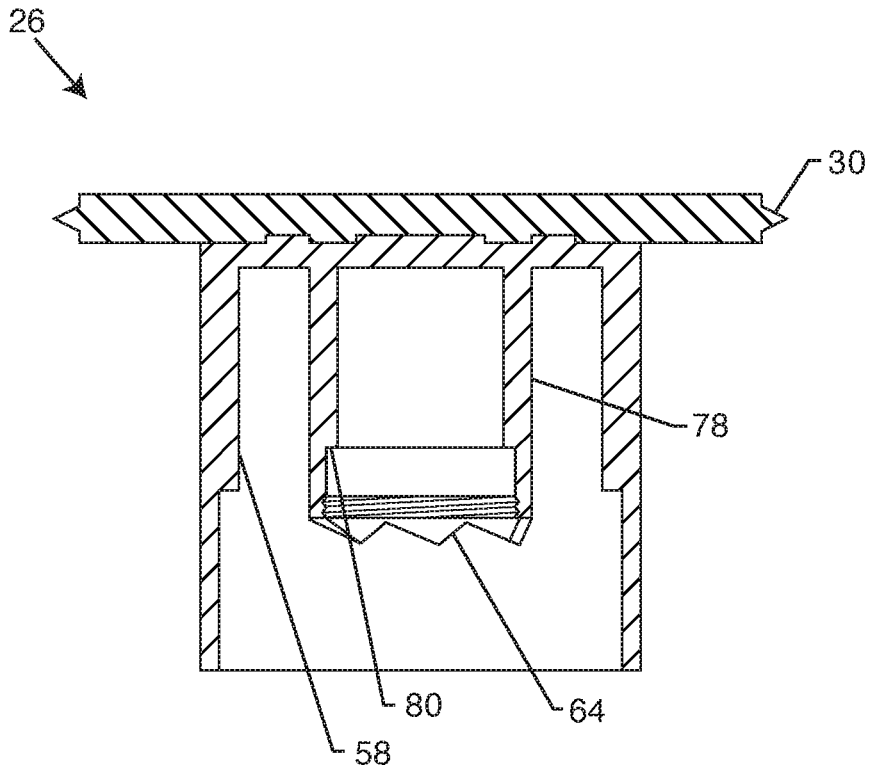
FIG. 6 is a sectional side view of just the upper plug body from FIGS. 3 and 5.
Figure 7:
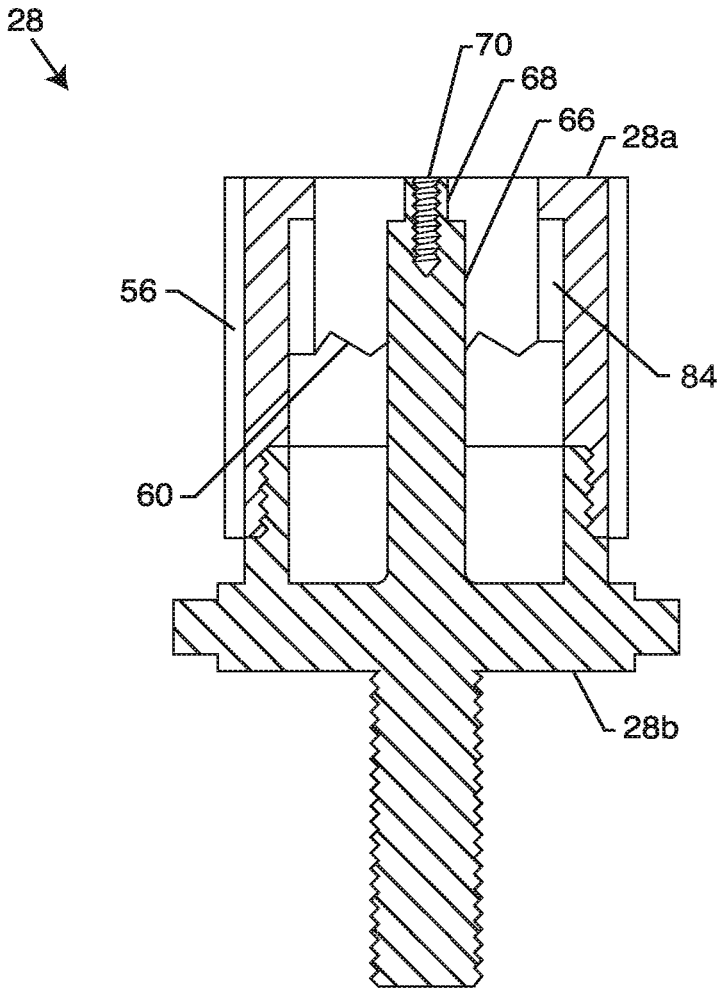
FIG. 7 is a sectional side view of just the lower plug body from FIGS. 3 and 5.
Figure 8:
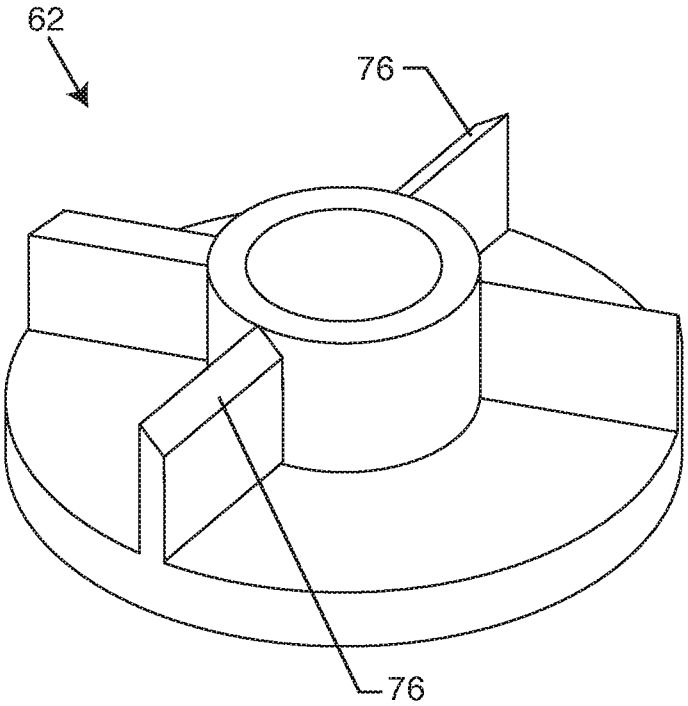
FIG. 8 is a perspective view of a toothed plate which is the same structure as shown in FIGS. 3 and 5.

As best shown in FIG. 5, a plug assembly 24 is configured to be disposed within the housing. The plug assembly comprises an upper plug body 26 and a lower plug body 28. The upper plug body is translatable with respect to the lower plug body but the upper plug body may not be rotatable with respect to the lower plug body. A guide channel 56 may be disposed in either the upper or lower plug body and a slide 58 may be disposed in the other of the upper or lower plug body, wherein the slide is configured to translate within the guide channel and prevent rotation between the upper and lower plug body. As shown herein, there would be four slides and four guide channels. However, just one slide and one guide channel would be sufficient. As shown herein, the slide 58 is part of the upper plug housing 26 and the guide channel 56 is part of the lower plug body 28. Due to the cross sectional views, only two of the slides and guide channels can be seen. The slide 58 is best shown in FIG. 6 where it would engage the guide channel 56 as best shown in FIG. 7.

Referring back to FIG. 3, a fluidic seal 30 is attached to the upper plug body and configured to removably engage in a water tight manner with the top side water inlet 20 of the housing. The seal 30 may be made from a rubber or rubber-like material such as silicone such that it can easily seal water or a fluid within the basin. The housing may include a removable top 14, wherein the top includes the top side water inlet. As shown herein, the top 14 has a male thread that engages a female thread on the housing 12.

A compression spring 32 is generally disposed between the upper plug body and the lower plug body. The compression spring biases the upper plug body to translate away from the lower plug body, or in other words the upper plug body is forced upwards to seal the basin. The compression spring is the only spring in the overflow drain assembly. Again, this novel design is a simplification of the cited prior art where the second spring has been eliminated.

A first permanent magnet 34 is attached to the lower plug body and a second permanent magnet 36 attached to the upper plug body. The first permanent magnet is magnetically attracted to the second permanent magnet and the first magnet is disposed at least partially above the second magnet. It is worth noting that just one magnet may be used. In other words, either, but not both, of the first permanent magnet or the second permanent magnet may be replaced with a ferromagnetic material. Two magnets would have an increased holding strength, but just one magnet and one ferromagnetic material could be used just as well.

A threaded shaft 38 may disposed below the lower plug body, wherein the threaded shaft is threadably engaged with the bottom portion of the housing. As shown in FIG. 1, the threaded shaft may be separate from the plug assembly. The threaded shaft may also comprise a hex head 40, wherein the hex head of the threaded shaft is accessible through the top portion of the housing when the plug assembly is removed. A top surface 42 of the screw head may be configured to abut a bottom surface 44 of the lower plug body, wherein rotation of the screw head either lowers or raises the top surface of the screw head in relation to the housing.

Figure 3:
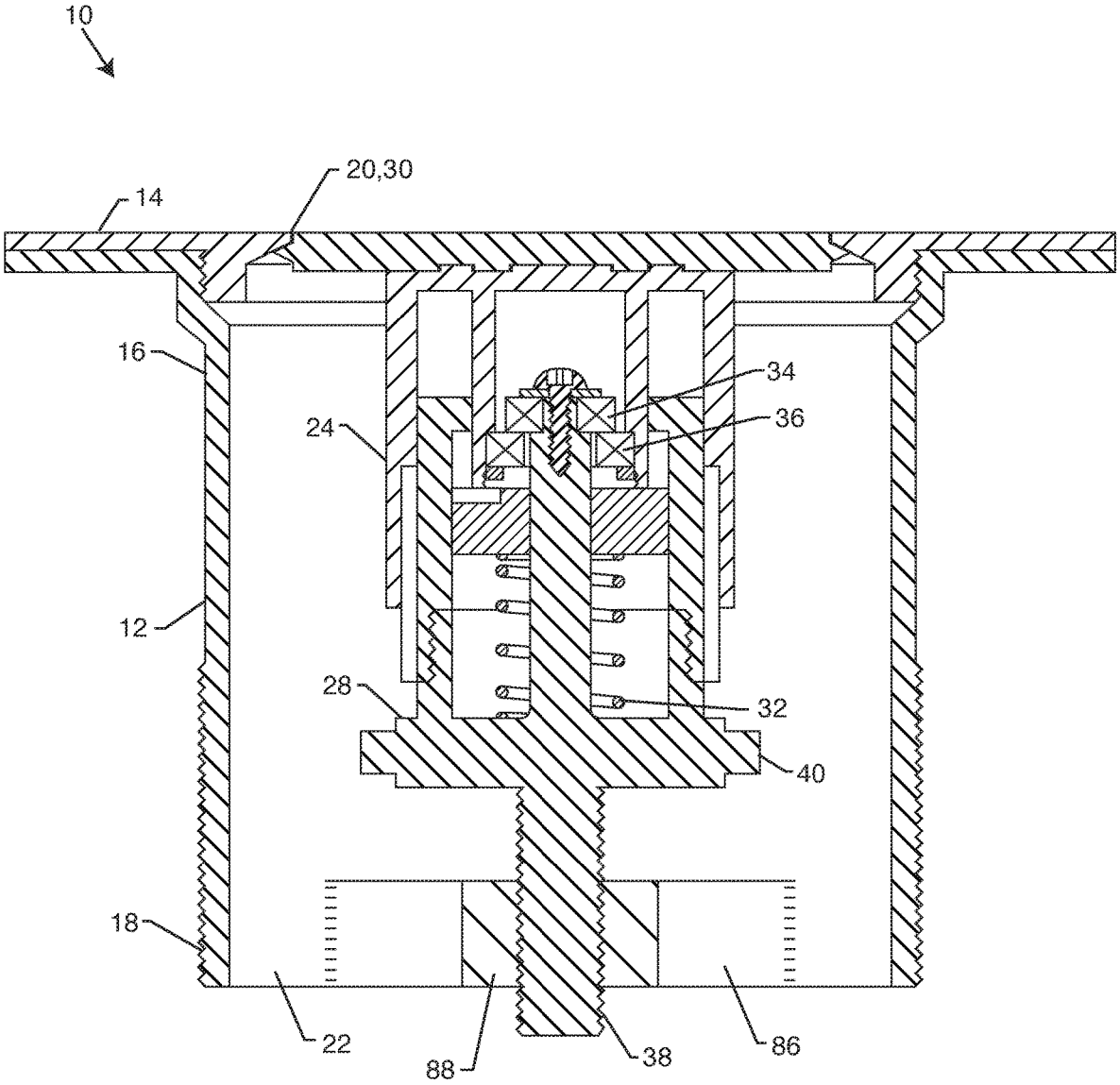
FIG. 3 is a sectional side view of a new embodiment of the present invention, showing how the overflow and tip-toe functionality have been combined to use a single compression spring with a reduced part count.
Figure 4:
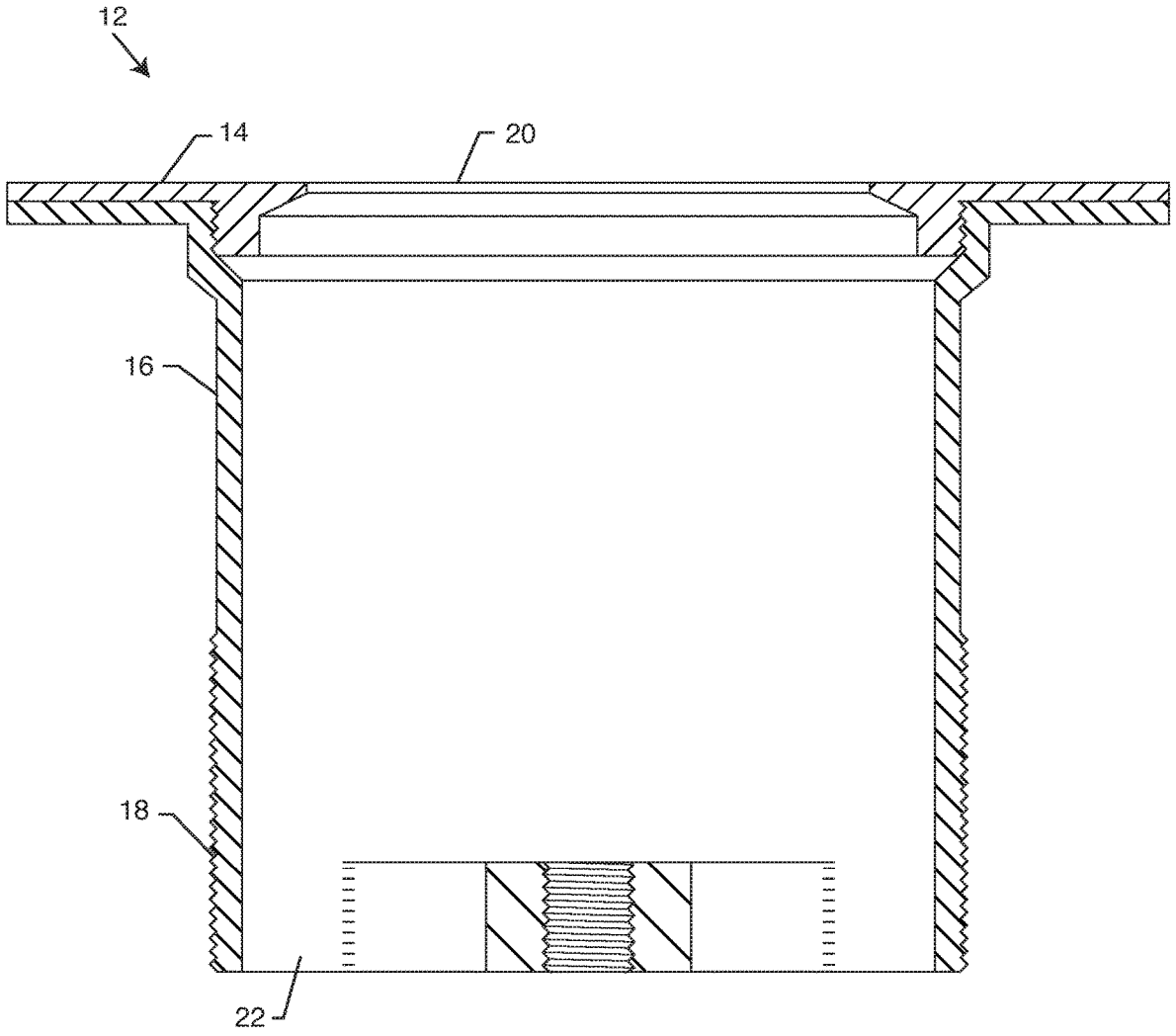
FIG. 4 is a sectional side view of just the housing from FIG. 3.

As shown in FIG. 3, the threaded shaft 38 may be attached to the lower plug body and including a hex head 40 which attached to either the threaded shaft or the lower plug body. Due to the cross sectional view, the shape of the hex head is hard to see yet it is understood to be a standard size and shape that is common to heads used for bolts and screws such that normal socket heads could engage it. The hex head 40 may have a larger diameter from its outermost flat surfaces in comparison to the rest of a diameter of the plug assembly, wherein a secondary tool (e.g. socket head) is configured to engage the hex head and rotate the plug assembly allowing the plug assembly to be rotated for either raising or lowering the plug assembly in relation to the housing. As shown in FIG. 3, struts 86 connect a center portion 88 of the housing such that water can flow past the struts 86 while still supporting the threaded shaft 38.

Referring back to FIG. 1, the upper plug body may comprise a plurality of guiding structures 46 configured to facilitate a vertical movement of the upper plug body within the housing. A flange 48 may be attached to the adjustment screw disposed within the housing, the flange configured to prevent the adjustment screw from passing through the bottom side water inlet while being able to pass through the top side water inlet when the plug assembly is removed. A stop 50 may be attached to a distal end of the adjustment screw disposed beyond the bottom portion of the housing, the stop configured to prevent the adjustment screw from being fully removed from the housing.

Referring back to FIGS. 3-10, the upper plug body is configured to be manually pushed downward a first time by a user to automatically lock into an open position where the fluidic seal 30 remains below the top side water inlet and wherein the upper plug body is configured to be manually pushed downward a second time by the user to automatically raise and lock into a closed position where the fluidic seal 30 engages with the top side water inlet in the water tight manner. To accomplish this, the lower plug body may comprise a variable position stepped track 60 (best shown in FIG. 7) configured for a toothed plate 62 (best shown in FIG. 8) to engage therein. The toothed plate is disposed between the compression spring and the variable position stepped track as shown in FIGS. 3 and 5. A cam surface 64 (best shown in FIG. 6) is attached to the upper plug body, wherein the cam surface 64 is configured to abut the toothed plate disengaging the toothed plate from the variable position stepped track thereby allowing the toothed plate to advance to a different position along the stepped track. The toothed plate is rotatable and translatable with respect to the upper and lower plug body.

FIGS. 9A-D are simplified representations of how the toothed plate 62 moves with respect to the variable positioned stepped track 60 and the cam surface 64. In actuality, the variable positioned stepped track 60 is formed on an inside cylindrical surface of the lower plug body 28. To ease manufacture, the lower plug body is shown in FIG. 7 as having an upper portion 28*a* and a lower portion 28*b*, which may be bonded together or threadably attached as shown. The lower portion 28*b* includes a protrusion 66 that has a step 68 for securing the magnet 34 thereto with a screw thread 70 such that then a washer 72 and a screw 74 hold the magnet 34 in place.

Referring back to FIGS. 9A-C, the variable positioned stepped track which is normally on the inside cylindrical surface of the lower plug body has been flattened such that its shape is easier to understand. The toothed plate 62 has a plurality of teeth 76 with angled surfaces. The angle on the teeth 76 are matched to abut and align the variable positioned stepped track. However, for simplicity just one of the teeth 76 are shown.

As best seen in FIG. 6, the upper plug body has a cylindrical protrusion 78 with a cam surface 64. The cam surface 64 is also configured to abut and align with the angled surface of the teeth 76. The cylindrical protrusion also has a step 80 to capture the second magnet 36. A retainer 82 (See FIG. 5) can then be bonded or fastened to the cylindrical protrusion to retain the magnet 36. For example, the retainer may be threaded or may be a snap ring.

Figure 9A:
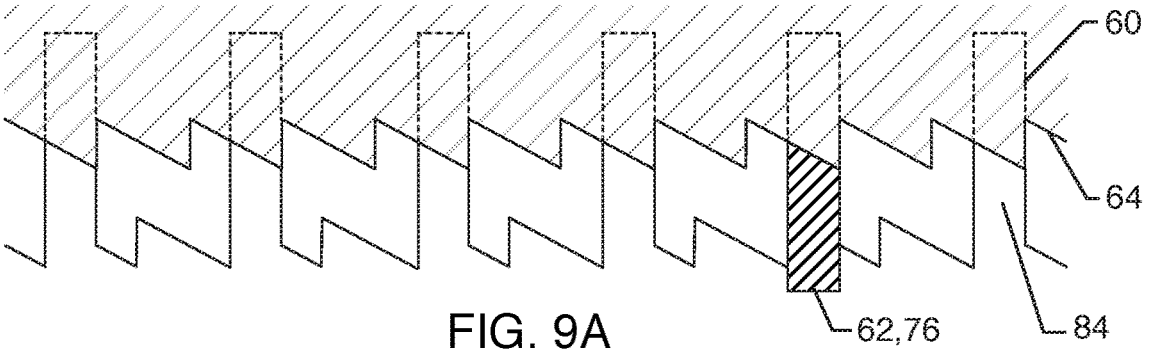
FIG. 9A is a linear representation of the tip-toe movement of the present invention as shown in FIGS. 3-8 of how a single tooth of the toothed plate advances along a variable position stepped track of the lower plug body due to the engagement and disengagement of a cam surface of the upper plug body.
Figure 9B:
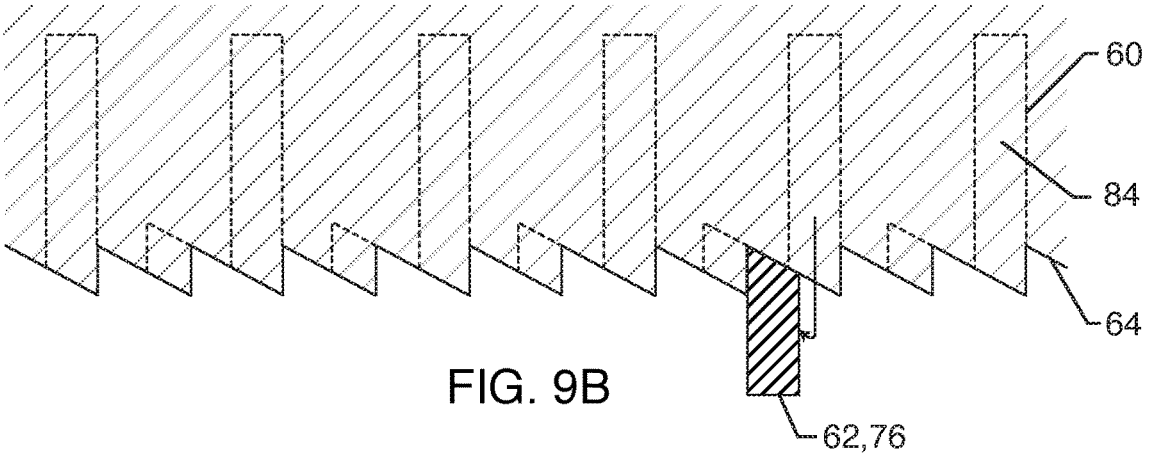
FIG. 9B is a similar linear representation as FIG. 9A now showing the single tooth of the tooth plate advancing.
Figure 9C:
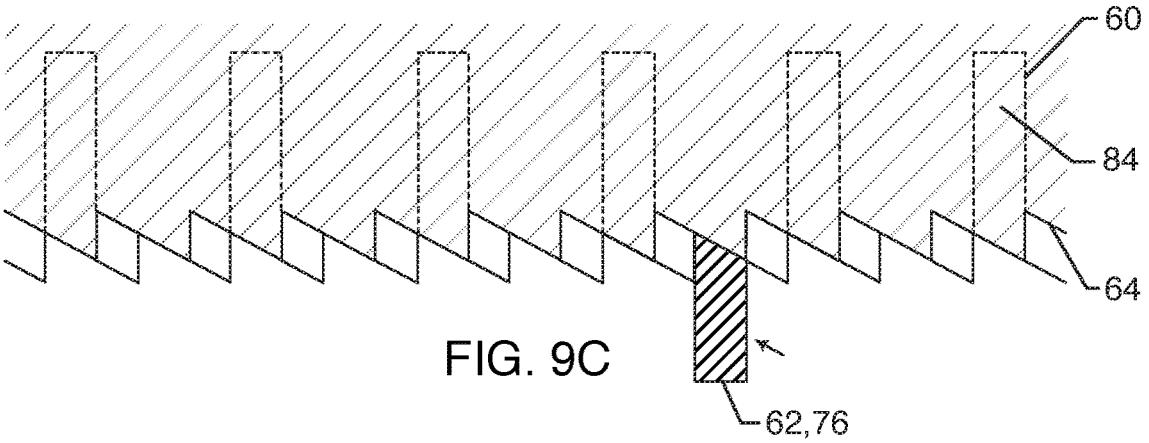
FIG. 9C is a similar linear representation as FIG. 9B now showing the single tooth of the tooth plate advancing yet again.
Figure 9D:
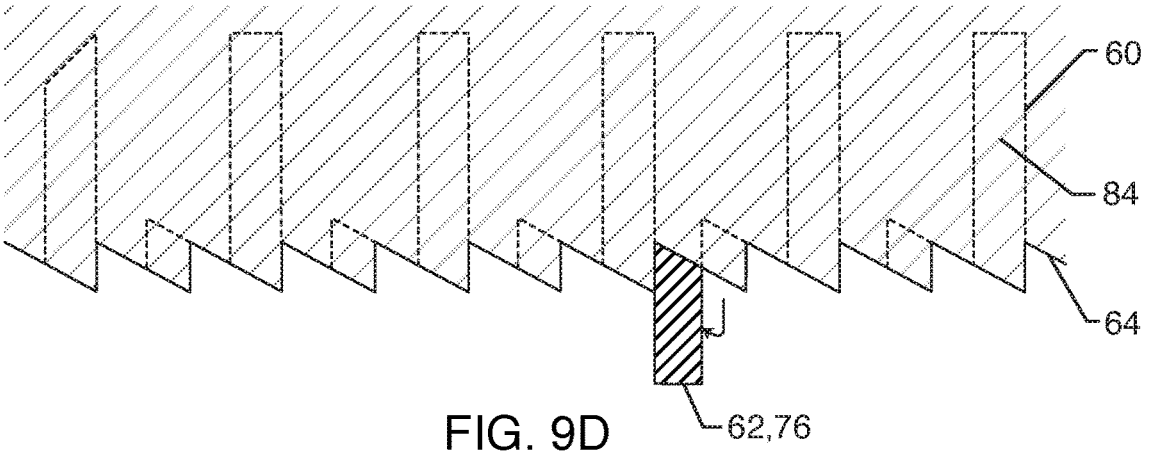
FIG. 9D is a similar linear representation as FIG. 9C now showing the single tooth of the tooth plate advancing yet again.

Referring back to FIG. 9A, the toothed plate 62 is being pressed upwards by the spring (not shown). The toothed plate 62 then engages the upper plug body and seal to close the top of the housing. As shown now in FIG. 9B, a user has pressed down on the upper plug body. This then drives the tooth 76 out of the slot 84. The tooth is still being pressed upwards by the spring, and due to its aligned surfaces, the toothed plate 62 actually now rotates such that the tooth moves to the left as shown in FIG. 9B. When the user releases the upper plug body, the toothed plate 62 rotates even further and drives the tooth upwards and to the left as shown in FIG. 9C. Now the upper plug body is being held down such that the drain is open and flowing. When the user presses the upper plug body for the second time, the cam surface 64 once again drives the tooth 76 down such that the toothed plate yet again rotates and the tooth 76 moves to the left. When the user releases the upper plug body, the tooth then slides back up into the next slot similar to FIG. 9A. Because the structures are all formed along cylinders, the cycle repeats itself over and over. Thus, the FIGS. 9A-D represent the continuous cycling that the present invention undergoes from opening to closing to opening to closing and thereon.

Figure 10:
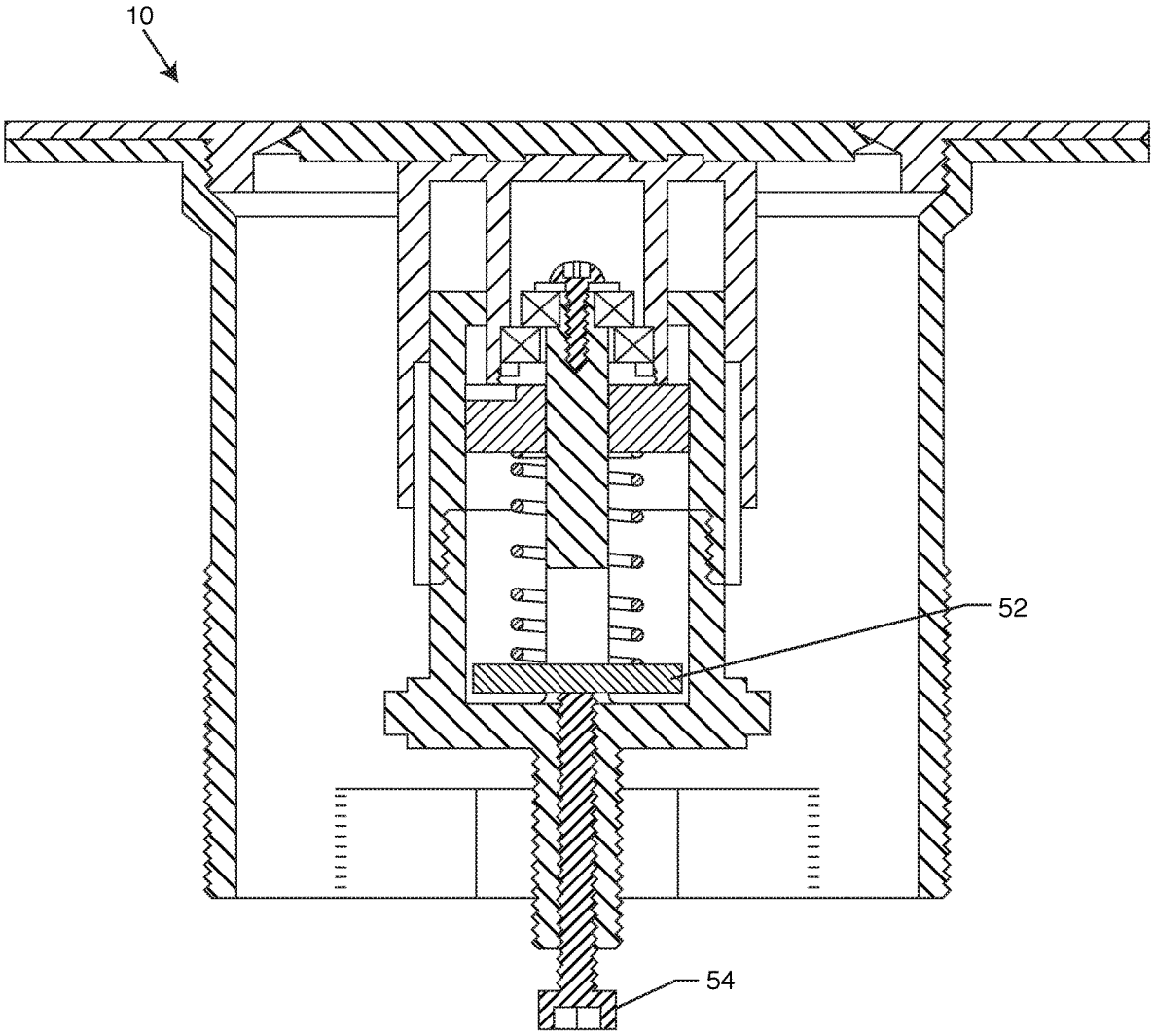
FIG. 10 is a view similar to FIG. 3, now showing an adjustment screw engaging a shim to compress the compression spring for adjustment of the overflow feature with respect to the height of water.

Referring now to FIG. 10, a shim 52 may be disposed between the compression spring and the lower plug body. An adjustment screw 54 may be threadably engaged with the lower plug body, the adjustment screw configured to push the shim compressing the compression spring when the adjustment screw is rotated.

Although several embodiments have been described in detail for purposes of illustration, various modifications may be made to each without departing from the scope and spirit of the invention. Accordingly, the invention is not to be limited, except as by the appended claims.

NUMERALS overflow drain assembly 10
housing 12
removable top 14
top portion 16
bottom portion 18
top side water inlet 20
bottom side water outlet 22
plug assembly 24
upper plug body 26
lower plug body 28
fluidic seal 30
compression spring 32
first permanent magnet 34
second permanent magnet 36
threaded shaft 38
hex head 40
top surface 42
bottom surface 44
plurality of guiding structures 46
flange 48
stop 50
shim 52
adjustment screw 54
guide channel 56
slide 58
variable position stepped track 60
toothed plate 62
cam surface 64 protrusion 66
step 68
screw thread 70
washer 72
screw 74
teeth 76
cylindrical protrusion 78
step 80
retainer 82
slot 84
struts 86
center portion 88

What is claimed is:

1. An overflow drain assembly, comprising:

a housing configured to be installed at a bottom of a basin, the housing having a top portion opposite a bottom portion, wherein a top side water inlet is disposed at the top portion of the housing and is configured to be exposed to contents of the basin and a bottom side water outlet is disposed at the bottom portion of the housing and is configured to be connectable to a drainage leading away from the basin;

a plug assembly configured to be disposed within the housing, the plug assembly comprising:

an upper plug body;

a lower plug body, wherein the upper plug body is translatable with respect to the lower plug body;

a fluidic seal attached to the upper plug body and configured to removably engage in a water tight manner with the top side water inlet of the housing;

a compression spring disposed between the upper plug body and the lower plug body, wherein the compression spring biases the upper plug body to translate away from the lower plug body, and wherein the compression spring is the only spring in the overflow drain assembly;

a first permanent magnet attached to the lower plug body;

a second permanent magnet attached to the upper plug body;

wherein the first permanent magnet is magnetically attracted to the second permanent magnet;

wherein the first magnet is disposed at least partially above the second magnet; and wherein the upper plug body is configured to be manually pushed downward a first time by a user to automatically lock into an open position where the fluidic seal remains below the top side water inlet and wherein the upper plug body is configured to be manually pushed downward a second time by the user to automatically raise and lock into a closed position where the fluidic seal engages with the top side water inlet in the water tight manner; and a threaded shaft disposed below the lower plug body, wherein the threaded shaft is threadably engaged with the bottom portion of the housing.

2. The overflow drain assembly of claim 1, wherein the threaded shaft is separate from the plug assembly, wherein the threaded shaft comprises a hex head, wherein the hex head of the threaded shaft is accessible through the top portion of the housing when the plug assembly is removed.

3. The overflow drain assembly of claim 2, wherein a top surface of the screw head is configured to abut a bottom surface of the lower plug body, wherein rotation of the screw head either lowers or raises the top surface of the screw head in relation to the housing.

4. The overflow drain assembly of claim 1, wherein the threaded shaft is attached to the lower plug body, and including a hex head attached to either the threaded shaft or the lower plug body.

5. The overflow drain assembly of claim 4, wherein the hex head has outermost flat surfaces which define a hex head diameter, and that the hex head diameter is larger in comparison to the rest of a diameter of the lower plug body.

6. The overflow drain assembly of claim 5, wherein the hex head is configured for a secondary tool to engage the hex head and thereby rotate the lower plug assembly allowing the lower plug assembly to be rotated for either raising or lowering the lower plug assembly in relation to the housing.

7. The overflow drain assembly of claim 1, including a shim disposed between the compression spring and the lower plug body.

8. The overflow drain assembly of claim 7, including an adjustment screw threadably engaged with the lower plug body, the adjustment screw configured to push the shim compressing the compression spring when the adjustment screw is rotated.

9. The overflow drain assembly of claim 1, wherein the housing includes a removable top, wherein the top includes the top side water inlet.

10. The overflow drain assembly of claim 1, wherein the upper plug body comprises a plurality of guiding structures configured to facilitate a vertical movement of the upper plug body within the housing.

11. The overflow drain assembly of claim 1, wherein either, but not both, of the first permanent magnet or the second permanent magnet is capable of being replaced with a ferromagnetic material.

12. The overflow drain assembly of claim 1, including a flange is attached to the threaded shaft disposed within the housing, the flange configured to prevent the threaded shaft from passing through the bottom side water inlet while being able to pass through the top side water inlet when the plug assembly is removed.

13. The overflow drain assembly of claim 1, including a stop attached to a distal end of the threaded shaft disposed beyond the bottom portion of the housing, the stop configured to prevent the threaded shaft from being fully removed from the housing.

14. The overflow drain assembly of claim 1, wherein the upper plug body is not rotatable with respect to the lower plug body.

15. The overflow drain assembly of claim 14, wherein a guide channel is disposed in either the upper or lower plug body and a slide is disposed in the other of the upper or lower plug body, wherein the slide is configured to translate within the guide channel and prevent rotation between the upper and lower plug body.

16. The overflow drain assembly of claim 14, wherein the upper plug body comprises a variable position stepped track configured for a toothed plate to engage therein, the toothed plate disposed between the compression spring and the variable position stepped track, and further including a cam surface attached to the upper plug body, wherein the cam surface is configured to abut the toothed plate, thereby disengaging the toothed plate from the variable position stepped track thereby allowing the toothed plate to advance to a different position along the stepped track.

17. The overflow drain assembly of claim 16, wherein the toothed plate is rotatable and translatable with respect to the upper and lower plug body.

18. An overflow drain assembly, comprising:

a housing configured to be installed at a bottom of a basin, the housing having a top portion opposite a bottom portion, wherein a top side water inlet is disposed at the top portion of the housing and is configured to be exposed to contents of the basin and a bottom side water outlet is disposed at the bottom portion of the housing and is configured to be connectable to a drainage leading away from the basin;

a plug assembly configured to be disposed within the housing, the plug assembly comprising:

an upper plug body;

a lower plug body, wherein the upper plug body is translatable with respect to the lower plug body and wherein the upper plug body is not rotatable with respect to the lower plug body, wherein a guide channel is disposed in either the upper or lower plug body and a slide is disposed in the other of the upper or lower plug body, wherein the slide is configured to translate within the guide channel and prevent rotation between the upper and lower plug body;

a fluidic seal attached to the upper plug body and configured to removably engage in a water tight manner with the top side water inlet of the housing;

a compression spring disposed between the upper plug body and the lower plug body, wherein the compression spring biases the upper plug body to translate away from the lower plug body, and wherein the compression spring is the only spring in the overflow drain assembly;

a first permanent magnet attached to the lower plug body;

a second permanent magnet attached to the upper plug body;

wherein the first permanent magnet is magnetically attracted to the second permanent magnet;

wherein the first magnet is disposed at least partially above the second magnet;

wherein the upper plug body comprises a variable position stepped track configured for a toothed plate to engage therein, the toothed plate disposed between the compression spring and the variable position stepped track, and further including a cam surface attached to the upper plug body, wherein the cam surface is configured to abut the toothed plate disengaging the toothed plate from the variable position stepped track thereby allowing the toothed plate to advance to a different position along the stepped track, and wherein the toothed plate is rotatable and translatable with respect to the upper and lower plug body; and wherein the upper plug body is configured to be manually pushed downward a first time by a user to automatically lock into an open position where the fluidic seal remains below the top side water inlet and wherein the upper plug body is configured to be manually pushed downward a second time by the user to automatically raise and lock into a closed position where the fluidic seal engages with the top side water inlet in the water tight manner; and a threaded shaft disposed below the lower plug body, wherein the threaded shaft is threadably engaged with the bottom portion of the housing.

* * * * *